United States Patent [19]

Boyd

[11] 4,305,518

[45] Dec. 15, 1981

[54] PORTABLE CHEMICAL RESISTANT FIBERGLASS REINFORCED PLASTIC STORAGE TANK

[76] Inventor: John W. Boyd, P.O. Drawer 1265, Barnwell, S.C. 29812

[21] Appl. No.: 70,896

[22] Filed: Aug. 29, 1979

[51] Int. Cl.[3] ..... B65D 88/06; B65D 90/08

[52] U.S. Cl. ..... 220/5 A

[58] Field of Search ..... 220/5 A

[56] References Cited

U.S. PATENT DOCUMENTS

| | | | |
|---|---|---|---|
| 1,073,871 | 9/1913 | Sillman | 220/5 A |
| 2,806,629 | 9/1957 | Osborne | 220/5 A |
| 3,064,770 | 11/1962 | Andrews | 220/5 A |
| 3,513,248 | 5/1970 | Bright | 220/5 A |
| 3,700,512 | 10/1972 | Pearson | 220/5 A |
| 3,990,600 | 11/1976 | Rossitto | 220/5 A |
| 4,068,777 | 1/1978 | Humphrey | 220/5 A |

FOREIGN PATENT DOCUMENTS

| | | | |
|---|---|---|---|
| 52-8512 | 1/1977 | Japan | 220/5 A |
| 52-26610 | 2/1977 | Japan | 220/5 A |

*Primary Examiner*—George E. Lowrance

*Attorney, Agent, or Firm*—Bailey, Dority & Flint

[57] ABSTRACT

A portable fiberglass reinforced plastic storage tank is disclosed which includes a plurality of molded preformed base sections which may be assembled to form a base of a desired diameter and a plurality of vertical side panels having an interior composite layer which includes an exposed chemical resistant interior surface and reinforced vertical and circumferential joints.

3 Claims, 8 Drawing Figures

PORTABLE CHEMICAL RESISTANT FIBERGLASS REINFORCED PLASTIC STORAGE TANK

BACKGROUND OF THE INVENTION

The invention relates to portable storage tanks which may be assembled in bottom and side sections which are within the suitable limits of motor freight and may be assembled in the field.

Heretofore, portable storage tanks have been proposed such as in U.S. Pat. Nos. 1,073,871 and 212,983, which disclose various arrangements of providing an integral storage tank by assembling sectional pieces. However, these tanks are of relatively great weight limiting the size thereof and the constructions disclosed are not suitable for storing corrosive chemicals.

SUMMARY OF THE INVENTION

It has been found according to the invention that an improved portable storage tank which is lightweight and readily shippable can be provided by utilizing a construction of fiberglass reinforced plastic laminated bottom sections and side panels wherein the bottom sections and side panels may be assembled in an integral manner and the joints therebetween sealed and reinforced by a composite layer and having a chemically resistant interior surface whereby a relatively large lightweight storage tank may be had for corrosive chemicals.

Accordingly, an important object of the present invention is to provide a lightweight portable fiberglass reinforced storage tank which may be constructed in-shop, shipped by motor freight, and assembled at a job site.

Another important object is to provide a portable shippable storage tank having reinforced joints capable of withstanding high wind and moment loads, particularly when not full.

Still another important object of the present invention is the provision of a portable reinforced storage tank having a highly chemically resistant interior surface for storing corrosive materials.

Yet another important object of the present invention is to provide a portable reinforced storage tank which includes bottom sections and integral side panels utilizing vertical and horizontal flanges for alignment and assembly of the tank and the provision of additional hoop strength through the horizontal flanges and mid section stiffening ribs.

BRIEF DESCRIPTION OF THE DRAWING

The construction designed to carry out the invention will be hereinafter described, together with other features thereof.

The invention will be more readily understood from a reading of the following specification and by reference to the accompany drawing forming a part thereof, wherein an example of the invention is shown and wherein.

DESCRIPTION OF A PREFERRED EMBODIMENT

Figure 1:
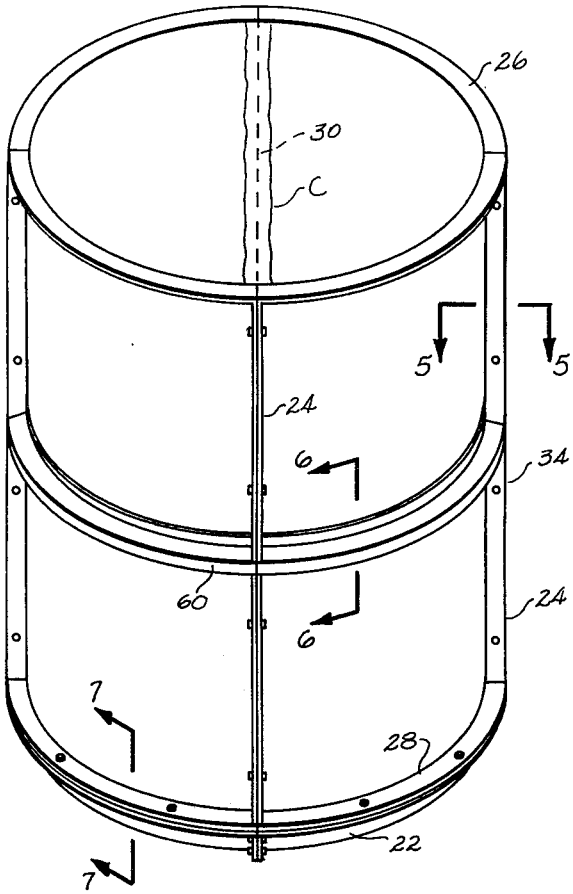
FIG. 1 is a perspective view illustrating a portable fiberglass reinforced storage tank according to the invention.
Figure 2:
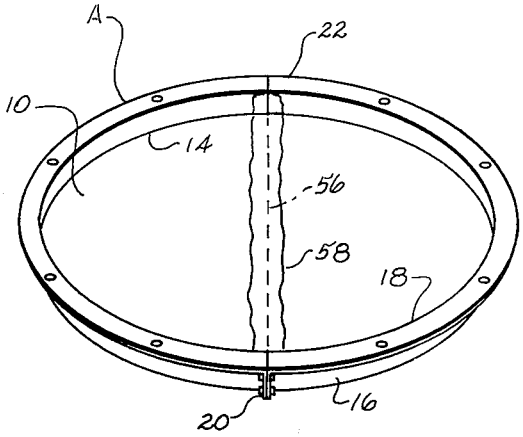
FIG. 2 is a perspective view illustrating an integral bottom base for an integral storage tank constructed according to the invention.
Figure 3:
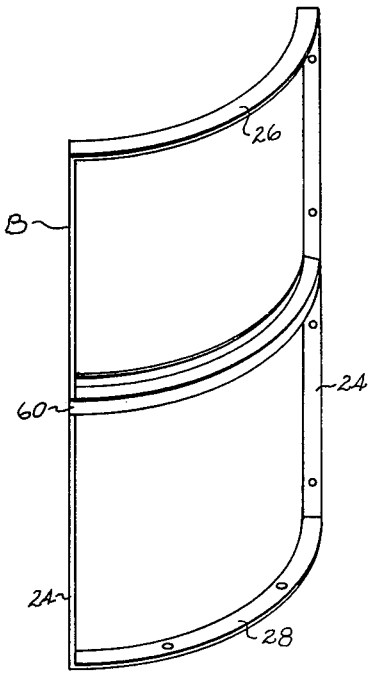
FIG. 3 is a perspective view illustrating a side panel for a storage tank according to the invention.
Figure 4:
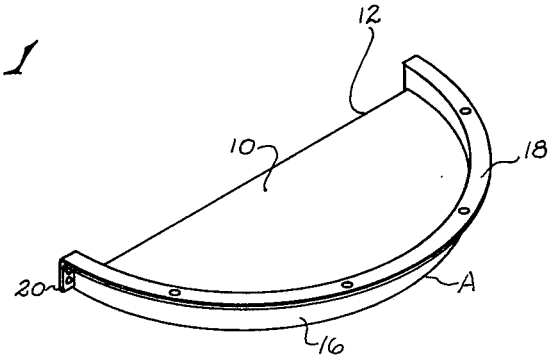
FIG. 4 is a perspective view illustrating a bottom section constructed according to the invention.
Figure 5:
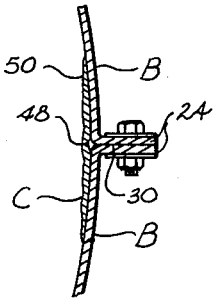
FIG. 5 is a sectional view taken along line 5—5 of FIG. 1 illustrating a reinforced vertical joint according to the invention.
Figure 6:
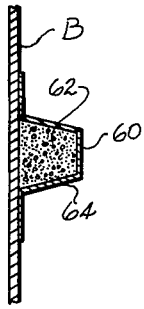
FIG. 6 is a sectional view taken along line 6—6 of FIG. 1 illustrating a midsection stiffener according to the invention.
Figure 7:
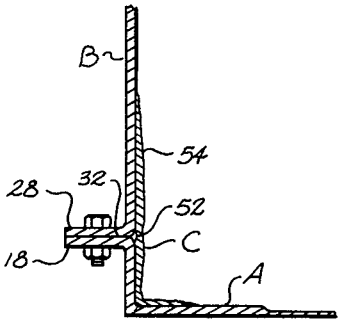
FIG. 7 is a sectional view taken along line 7—7 of FIG. 1 illustrating a circumferential joint according to the invention.
Figure 8:
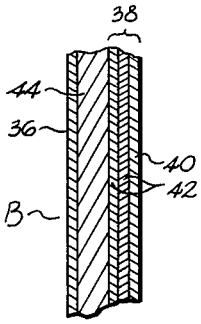
FIG. 8 is a cross-sectional illustration of a bottom and side wall laminated construction according to the invention.

The drawing illustrates a portable fiberglass reinforced plastic (FRP) storage tank which includes a plurality of molded preformed bottom base sections A and a plurality of molded preformed arcuate side panels B. Each base section A consists essentially of a continuously flat bottom surface 10 terminating in a free linear edge 12 flush with the flat bottom surface and in an outer arcuate edge 14, an upstanding circumferential wall portion 16 extending vertically from the arcuate edge of the flat bottom surface, and a horizontal flange 18 extending radially from an upper edge of the circumferential wall portion terminating at free circumferential ends. Connecting flanges 20 for connecting the base sections with one another are defined by the circumferential flange terminating in downwardly extending flanges perpendicular to the circumferential flange and the circumferential wall portion at the free circumferential ends thereof. Connecting means are provided for securing respective connecting flanges of adjacent base sections to provide an integral bottom base 22 having a desired diameter.

Molded vertical side panels B terminate laterally at linear edges whereat outwardly extending vertical flanges 24 are formed along the height of the side panels. An arcuate horizontal flange 26 and 28 extends radially from the upper and lower free ends of the side panels with the lower flange 28 coextending and mating with the horizontal flange 18 of the base section for adjoining connection therewith. The side panels adjoining one another define vertical joints 30 between adjacent vertical flanges thereof and adjoin the bottom base 22 to define a circumferential joint 32 between the mating horizontal flanges 18 and 28. The vertical flanges include connecting means by which adjacent side sections may be connected to form an integral cylindrical storage tank 34 corresponding in diameter to the bottom base 22. Joint reinforcing means C carried internally of the cylindrical storage tank bridge the vertical and circumferential joints along the entire length thereof sealing and reinforcing the joints and tank which includes a resin putty filling any void space in the joints and construction of an overlay of resin coated material over the joints.

The base sections A and side panels B are constructed of a laminated fiberglass structure which includes various layers of chemical surfacing veil, chopped glass strand mat, and woven glass roving. The chemical surfacing veil is preferably a type C, chemical grade glass of at least ten mil thickness. A suitable material is chemical grade glass manufactured by Owens Corning as product no. OCM514-236. The chopped strand mat may be any suitable type E, electrical grade glass, preferably one and one-half ounce per square foot weight with a fiber length greater than one-half inch and less than two inches. The woven roving may be any suitable type E electrical grade glass and one suitable type roving includes a 4 by 5 plain weave. Any suitable chemical resistant polyester or furan resin may be utilized such as furan QuaCorr Resin (QX-1001) and catalyst (QX-2001). Any conventional process such as hand layup (contact molding) may be utilized in forming the laminated construction of bottom sections A and side panels B.

Referring in more detail to the drawing, the layup of side panels B includes an exposed exterior surface 36 which is preferably a smooth surface layer having no exposed glass fibers. The interior of the side panel includes a composite liner layer 38 which includes an exposed interior surface layer 40 formed from the chemical grade glass surfacing veil which presents a highly chemical resistant interior surface for the tank and at least two adjacent layers 42 of chopped glass strand mat. This portion of the liner preferably contains between twenty and thirty percent glass by weight. An intermediate composite structural reinforcing layer 44 may include as many subsequent reinforcing layers as desired between the smooth exterior 36 and the liner 38. The structural reinforcing layers may include the chopped strand mat and woven roving plies alternating as desired for reinforcement. The thickness of the wall of side panels B may be made to vary with the height and decrease proportionally with the height to provide moment which will adequately accommodate hydrostatic pressures. In one embodiment, the thickness of the side panel wall decreased from 0.76 inches at the base to 0.37 inches at the top of a tank 18 and a half feet in height.

Vertical joints 30 formed between adjacent vertical flanges of adjoining side panels are constructed by filling any void space such as 48 with the resin putty so as to produce smooth surfaces and then reinforced and sealed with a composite overlay 50 of resin coated fiberglass. The reinforcing overlay 50 may consist of a composite layer like liner 38 which includes an outer exterior layer of chemical grade glass veil and at least two plys of chopped strand mat coated with resin. The overlay provides a smooth contoured joint that blends gradually into the interior shell. It has been found that an overlay width of at least ten inches on either side of the joint and a thickness equal to or greater than that of the side panel wall thickness affords reinforcement enabling the erected storage tank to effectively withstand wind and moment loads. Circumferential joint 32 likewise includes a resin putty 52 filling any void space and an overlay 54 of reinforcing material which includes a composite layup of chopped glass mat and glass surfacing veil as in liner 38. Bottom joints 56 between adjoining base sections A likewise are provided with an overly 58 of reinforcing material identical to layup 54.

Means for connecting the horizontal and vertical flanges may include bolts which may be resin coated and spaced holes formed in the flanges.

In one application a storage tank approximately eighteen feet in height and sixteen feet in diameter was constructed in which two base sections and four side panels were utilized. It is to be understood of course, that four pie-shaped bottom sections may also be utilized.

A mid-section stiffener member 60 is utilized which includes a foam stiffener strip 62 encircling the mid section of the tank 34 and an overlay 64 of resin coated fiber-glass material. Circumferential stiffener 60 provides a moment of inertia adequate to enable the tank to prevent collapse due to wind loads and wind vacuum effects, particularly when the tank is empty or only partially full, and provides increased hoop strength. Utilization of top flange 26 also adds to the hoop strength and aids against collapse, and may be utilized for attaching a tank top if desired or in some applications, a top may be dispensed with.

Thus, it can be seen that a shippable portable storage tank construction can be had according to the invention which is lightweight yet whose reinforced construction allows large capacity storage tank constructions and which has a highly chemical resistant interior surface for accommodating storage of corrosives.

While a preferred embodiment of the invention has been described using specific terms, such description is for illustrative purposes only, and it is to be understood that changes and variations may be made without departing from the spirit or scope of the following claims.

What is claimed is:

1. A portable fiberglass reinforced plastic storage tank comprising:

a plurality of molded preformed bottom base sections;

each said base section consisting essentially of a continuously flat bottom surface terminating in a free linear edge flush with said flat bottom surface and in an outer arcuate edge, an upstanding circumferential wall portion extending vertically from said arcuate edge of said flat bottom surface, and a horizontal circumferential flange extending radially from an upper edge of said upstanding circumferential wall portion terminating at free circumferential ends;

connecting flange means for connecting said base sections with one another defined by said horizontal circumferential flange terminating in a downwardly extending flange perpendicular to said horizontal circumferential flange and said upstanding circumferential wall portion at said free circumferential ends;

connecting flange means of adjacent bottom sections mating generally flush with one another and affording vertical support rigidity to said tank structure;

connecting means securing respective connecting flange means of adjacent base sections in an adjoining manner to provide an integral bottom base of a desired diameter;

a plurality of molded preformed vertical arcuate side panels terminating laterally in linear side edges;

outwardly extending vertical flanges formed at said side edges along the height of said side panel;

an arcuate horizontal flange extending radially from upper and lower free ends of said side panels, said lower flange coextending and mating with said horizontal circumferential flange of said base section for adjoining connection therewith;

said side panels adjoining one another to define vertical joints between adjacent vertical flanges thereof and adjoining said bottom base to define a circumferential joint between said mating horizontal flanges;

said vertical flanges of said side sections including connecting means by which adjacent side sections may be connected together to form an integral cylindrical storage tank corresponding in diameter to said bottom base;

joint reinforcing means carried internally of said cylindrical storage tank bridging said vertical joints and said circumferential joint along the entire length thereof reinforcing and sealing said tank including a chemically resistant overlay of resin coated material carried over said joints;

said overlay of material having a thickness greater than or equal to the thickness of the wall of said side panels; and a circumferential stiffening element carried about a medial portion of the exterior of said side panels of said integral storage tank which includes a urethane foam stiffener strip encircling said tank and a layer of resin coated reinforced material covering said foam strip which together with horizontal flange of said side panels affords a reinforcing moment enabling said tank to withstand wind and vacuum loads such as when partially filled.

2. The structure of claim 1 wherein said side panels include an interior liner composite layer which includes an exposed interior surface layer of chemical grade glass presenting a chemically resistant interior veil surface and at least two adjacent layers of reinforced chopped-glass strand mat material.

3. The structure of claim 2 wherein said joint reinforcing overly material includes a composite layer which includes at least two plys of chopped glass mat and an outer exposed resin-rich veil layer of chemical grade glass.

* * * * *